US010344420B2

(12) United States Patent
Cho et al.

(10) Patent No.: US 10,344,420 B2
(45) Date of Patent: Jul. 9, 2019

(54) WASHING MACHINE

(71) Applicant: Samsung Electronics Co., Ltd., Gyeonggi-do (KR)

(72) Inventors: Hwang Mook Cho, Suwon-si (KR); Seung Youp Lee, Yongin-si (KR); In Cheol Jang, Hwaseong-si (KR); Geon Ung Lee, Hwaseong-si (KR); Doo Young Rou, Suwon-si (KR); Eung Ryeol Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 154 days.

(21) Appl. No.: 15/416,915

(22) Filed: Jan. 26, 2017

(65) Prior Publication Data

US 2017/0211223 A1 Jul. 27, 2017

(30) Foreign Application Priority Data

Jan. 26, 2016 (KR) ..... 10-2016-0009088

(51) Int. Cl.
*D06F 39/08* (2006.01)
*D06F 23/06* (2006.01)
*D06F 37/26* (2006.01)

(52) U.S. Cl.
CPC ..... *D06F 39/085* (2013.01); *D06F 23/06* (2013.01); *D06F 39/083* (2013.01); *D06F 37/266* (2013.01)

(58) Field of Classification Search
CPC .... D06F 37/266; D06F 39/083; D06F 39/085; D06F 23/06
See application file for complete search history.

(56) References Cited

U.S. PATENT DOCUMENTS

2004/0025544 A1* 2/2004 Kim ..... B05B 1/267 68/3 R
2005/0022564 A1 2/2005 Kim et al.
2009/0249840 A1* 10/2009 Jo ..... D06F 39/008 68/5 C
2011/0083477 A1* 4/2011 Kim ..... D06F 37/266 68/140
2011/0088172 A1* 4/2011 Im ..... D06F 33/02 8/137
2011/0099727 A1* 5/2011 Kim ..... D06F 35/006 8/137
2014/0033449 A1* 2/2014 Im ..... D06F 39/08 8/137
2014/0352363 A1* 12/2014 Kim ..... D06F 39/083 68/140

FOREIGN PATENT DOCUMENTS

KR 20050015692 A 2/2005
KR 20080032332 A 4/2008
KR 20140140435 A 12/2014

* cited by examiner

*Primary Examiner* — Joseph L. Perrin

(57) ABSTRACT

Disclosed herein are a washing machine including an air-stream guide configured to guide a rotating air-stream generated by rotation of the drum toward the spray opening. The washing machine having the circulation apparatus can prevent water or bubbles remaining in the tub and the pump room from flowing into the inside of the drum along the circulation path of the circulation apparatus, due to a pressure difference made between the center area and the outer area of the tub during spin-drying in which the drum rotates at high speed.

17 Claims, 11 Drawing Sheets

WASHING MACHINE

CROSS-REFERENCE TO RELATED APPLICATION(S) AND CLAIM OF PRIORITY

This application claims the benefit of Korean Patent Application No. 10-2016-0009088, filed on Jan. 26, 2016 in the Korean Intellectual Property Office, the disclosure of which is incorporated herein by reference.

BACKGROUND

1. Field

Embodiments of the present disclosure relate to a washing machine, and more particularly, to a washing machine having a circulation apparatus for circulating washing water drained from a tub.

2. Description of the Related Art

In general, a washing machine is a home appliance for washing laundry by use of electricity. The washing machine can be classified into a drum type and an electromotive type. A drum type washing machine washes laundry by raising and dropping the laundry according to rotation of a tub, and an electromotive type washing machine washes laundry using water streams formed by a pulsator when a tub rotates.

Since the drum type washing machine washes laundry using an impact caused by falling of the laundry, a small amount of washing water is stored in the tub, and accordingly, the drum type washing machine may include a circulation apparatus to spray washing water drained from the lower portion of the tub toward the inside of the drum in order to wet the laundry and dissolve detergent.

The circulation apparatus includes a circulation path to circulate washing water, a circulation pump to pump washing water, and a circulation nozzle disposed at the end of the circulation path to spray washing water. The circulation apparatus operates when the washing machine performs washing to evenly wet laundry and sufficiently dissolve detergent.

However, when the washing machine performs spin-drying in which the drum rotates at high speed, water or bubbles remaining in the tub may flow into the inside of the drum along the circulation path, due to a pressure difference made between the center area and the outer area of the tub by a centrifugal force.

SUMMARY

Therefore, it is an aspect of the present disclosure to provide a washing machine having a circulation apparatus, which is capable of preventing water or bubbles remaining in a tub and a pump room from flowing into the inside of a drum along a circulation path due to a pressure difference made between the center area and the outer area of the tub during spin-drying in which the drum rotates at high speed.

Additional aspects of the disclosure will be set forth in part in the description which follows and, in part, will be obvious from the description, or may be learned by practice of the disclosure.

In accordance with one aspect of the present disclosure, a washing machine includes a main body, wherein a feeding entrance is formed in the front portion of the main body; a tub disposed in the inside of the main body, wherein an opening is formed in the tub in correspondence to the feeding entrance; a diaphragm configured to connect the feeding entrance to the opening; a drum disposed in the inside of the tub, and configured to rotate; and a circulation nozzle installed in the diaphragm, and configured to spray washing water drained from the tub to the inside of the drum, wherein the circulation nozzle includes a spray opening configured to spray washing water, and an air-stream guide configured to guide a rotating air-stream generated by rotation of the drum toward the spray opening.

The air-stream guide may protrude toward the drum from one edge of the spray opening.

The air-stream guide may be disposed downstream of the spray opening in a rotation direction of the drum.

The circulation nozzle may include a coupling portion disposed to penetrate the diaphragm, and a spray portion extending from the coupling portion and configured to change a movement direction of washing water toward the drum, and wherein the air-stream guide may protrude from the spray portion.

The spray portion may include a wall portion forming the spray opening thereinside, and the wall portion may include a bottom portion located closer to the diaphragm than the spray opening, a upper wall portion facing the bottom portion, and a pair of side wall portions connecting the bottom portion to the upper wall portion, and wherein the air-stream guide may protrude from one of the pair of side wall portions.

The pair of side wall portions may have a wider width toward the outside in order to spread washing water.

The pair of side wall portions may include a first side wall portion and a second side wall portion, the air-stream guide may protrude from the second side wall portion, and an angle $\theta 1$ formed between the air-stream guide and the first side wall portion may be greater than or equal to an angle $\theta 2$ formed between the first side wall portion and the second side wall portion.

The air-stream guide may be positioned at a higher location than the spray opening.

The circulation nozzle may include an inlet to receive washing water, and flow space connecting the inlet to the spray opening, and the flow space may include first flow space formed in the inside of the coupling portion, and second flow space formed in the inside of the spray portion and configured to change a movement direction of washing water.

The circulation nozzle may include an inner fixing portion that tightly contacts an inner area of the diaphragm in radial direction of the diaphragm to be supported by the inner area of the diaphragm in order to fix the circulation nozzle.

The circulation nozzle may include an outer fixing portion that tightly contacts an outer area of the diaphragm in radial direction of the diaphragm to be supported by the outer area of the diaphragm in order to fix the circulation nozzle.

The washing machine may further include a circulation apparatus configured to circulate washing water drained from the tub to the inside of the drum, wherein the circulation apparatus may include a pump room disposed below the tub, a circulation pump configured to pump washing water stored in the pump room, and a circulation hose configured to connect the pump room to the circulation nozzle.

The diaphragm nay include a rotation preventing portion configured to prevent the circulation nozzle from rotating.

In accordance with another aspect of the present disclosure, a washing machine includes a main body, wherein a feeding entrance is formed in the front portion of the main body; a tub disposed in the inside of the main body, wherein an opening is formed in the tub in correspondence to the feeding entrance; a diaphragm configured to connect the feeding entrance to the opening; a drum disposed in the inside of the tub, and configured to rotate; and a circulation nozzle installed in the diaphragm, and configured to spray washing water drained from the tub to the inside of the drum, wherein the diaphragm may include an air-stream inducer configured to induce a rotating air-stream generated by rotation of the drum to move toward the spray opening.

The air-stream inducer may protrude toward the drum, further than the spray opening.

The air-stream inducer may be disposed downstream of the spray opening in a rotation direction of the drum.

The air-stream inducer may include a rotation limiting portion configured to prevent the circulation nozzle from rotating.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, preferred embodiments of the present disclosure will be described in detail with reference to the accompanying drawings.

Figure 1:
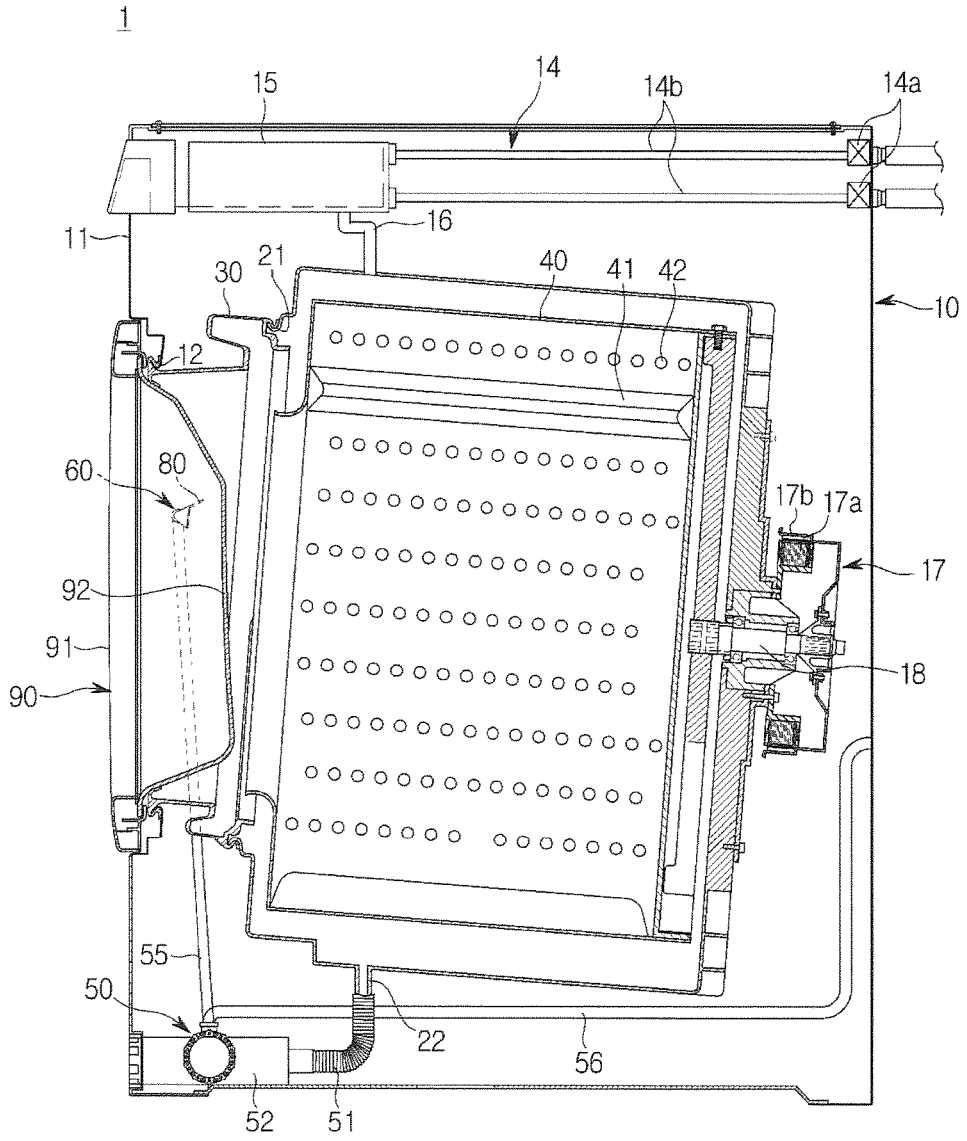
FIG. 1 is a cross-sectional view showing a schematic configuration of a washing machine according to an embodiment of the present disclosure.
Figure 2:
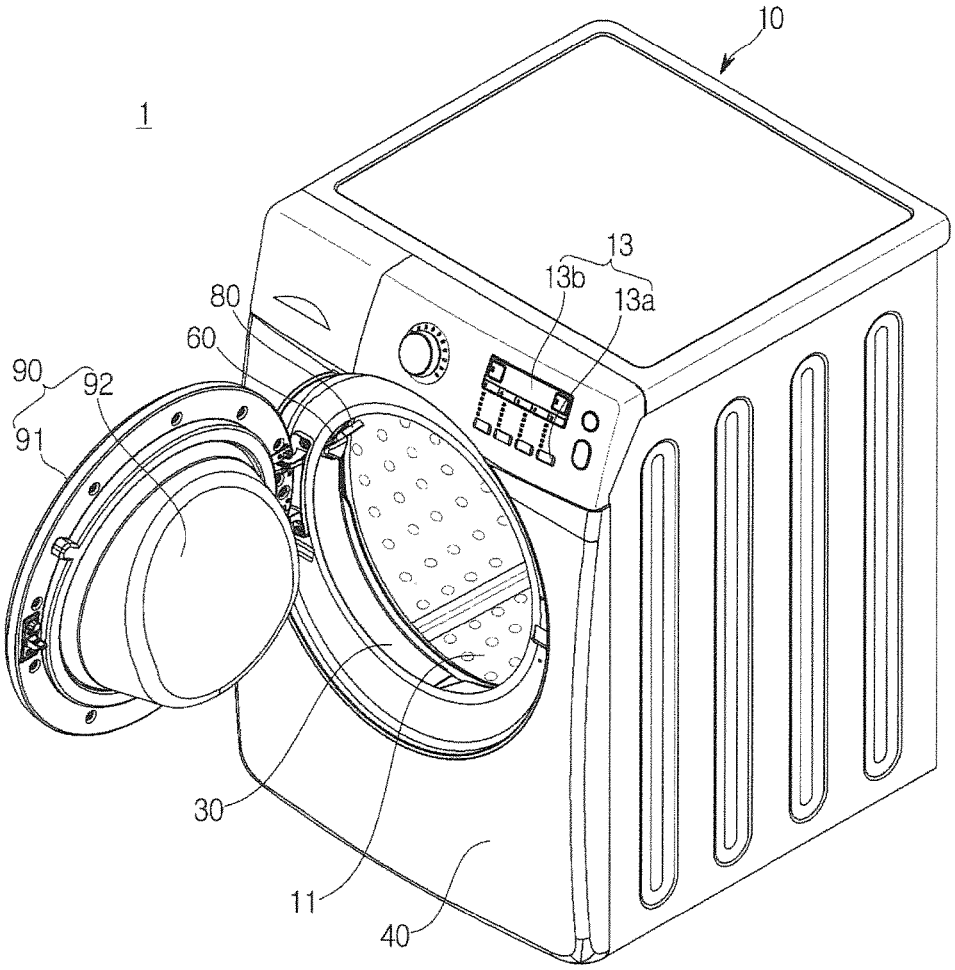
FIG. 2 is a perspective view showing a state when a door of the washing machine of FIG. 1 opens.

FIG. 1 is a cross-sectional view showing a schematic configuration of a washing machine according to an embodiment of the present disclosure, and FIG. 2 is a perspective view showing a state when a door of the washing machine of FIG. 1 opens.

Referring to FIGS. 1 and 2, a washing machine 1 may include a main body 10 forming the outer appearance of the washing machine 1 and configured to accommodate various components therein, a tub 20 disposed in the inside of the main body 10 and configured to store washing water, a drum 40 configured to accommodate laundry and to rotate, and a driving motor 17 configured to rotate the drum 40.

The main body 10 may have a box-like shape. The main body 10 may include a front plate 11, a rear plate, a top plate, a bottom plate, and side plates.

On the front plate 11, a control panel 13 having an input device 13*a* to receive operation commands from a user and a display 13*b* to display operation information of the washing machine 1 may be disposed. Also, in the front plate 11, a feeding entrance 12 may be formed to enable the user to put laundry into the inside of the drum 40.

The feeding entrance 12 of the main body 10 may be opened or closed by a door 90. The door 90 may be rotatably coupled with the main body 10 by a hinge member. The door 90 may be configured with a door frame 91 and a glass member 92.

The glass member 92 may be formed of a transparent tempered glass material so that the user can see the inside of the main body 10 through the glass member 92. The glass member 92 may protrude toward the inside of the tub 20 in order to prevent laundry from being pulled toward the door 90.

The tub 20 may store washing water, and may have a cylinder-like shape. The tub 20 may be fixed in the inside of the main body 10. In the current embodiment, the center axis of the tub 20 may be inclined with respect to a horizontal plane, however, the center axis of the tub 20 may be parallel to the horizontal plane. In the front part of the tub 20, an opening 21 may be formed to correspond to the feeding entrance 12.

The feeding entrance 12 of the front plate 11 may be connected to the opening 21 of the tub 20 by a diaphragm 30.

The diaphragm 30 may form a passage between the feeding entrance 12 of the front plate 11 and the opening 21 of the tub 20, so as to guide laundry put through the feeding entrance 12 to the inside of the drum 40, and to reduce transfer of vibration generated by rotation of the drum 40 to the main body 10.

The drum 40 may have an open front part, and may have a cylinder-like shape to be disposed in the inside of the tub 20. The center axis of the drum 40 may be parallel to the center axis of the tub 20.

The drum 40 may rotate in the inside of the tub 20. The drum 40 may rotate to raise or drop laundry, thereby performing washing. For this, a plurality of lifters 41 may be formed on the inner surface of the drum 40 to raise laundry when the drum 40 rotates. In the circumference of the drum 40, a plurality of through holes 42 may be formed to pass washing water stored in the tub 20 through.

Above the tub 20, a water feeding apparatus 14 may be disposed to supply washing water to the inside of the tub 20. The water feeding apparatus 14 may be configured with a water pipe 14*b* to which washing water is supplied from an external water feeding source, and a water valve 14*a* configured to open or close the water pipe 14*b*.

In the front upper portion of the main body 10, a detergent feeding apparatus 15 may be disposed to feed detergent to the tub 20. The detergent feeding apparatus 15 may be connected to the tub 20 through a feeding pipe 16. Washing water supplied through the water pipe 14*b* may be supplied to the inside of the tub 20 together with detergent via the detergent feeding apparatus 15.

On the rear surface of the tub 20, a driving motor 17 may be disposed to generate a rotation force for rotating the drum 40. The driving motor 17 may be configured with a fixed stator 17*a*, and a rotor 17*b* electromagnetically interworking with the stator 17*a* to rotate, to convert an electric force to mechanical torque.

The torque generated by the driving motor 17 may be transferred to the drum 40 through a driving shaft 18. The driving shaft 18 may be pressed in the rotor 17*b* of the driving motor 17 to rotate together with the rotor 17*b*, and penetrate the rear wall of the tub 20 to connect the drum 40 to the driving motor 17.

The washing machine 1 may include a circulation apparatus 50 to spray washing water drained from the tub 20 toward laundry accommodated in the drum 40. Generally, since a drum type washing machine like the current embodiment raises and drops laundry by rotating the drum 40 to wash the laundry using an impact caused by falling of the laundry, a small amount of washing water is stored in the tub 20, and accordingly, the circulation apparatus 50 may be provided to evenly wet the laundry with the washing water or to sufficiently dissolve detergent contained in the washing water.

The circulation apparatus 50 may include a pump room 52 disposed below the tub 20 and configured to store washing water drained from the tub 20, a circulation pump 53 (see FIG. 3) configured to pump the washing water stored in the pump room 52, and a circulation hose 55 configured to guide the washing water pumped by the circulation pump 53.

The pump room 52 may be connected to a drain 22 of the tub 20 by the connection hose 51. The circulation pump 53 may include a circulation motor configured to generate a driving force, and an impeller configured to rotate by the driving force generated by the circulation motor and to make a pressure difference to pump the washing water.

One end of the circulation hose 55 may be connected to the pump room 52, and the other end of the circulation hose 55 may be connected to a circulation nozzle 60 for spraying washing water, so that the circulation hose 55 guides the washing water stored in the pump room 52 to the circulation nozzle 60.

The circulation nozzle 60 may spray washing water circulated by the circulation apparatus 50 to the inside of the drum 40. The circulation nozzle 60 may be installed to the left upper portion of the diaphragm 30 when seen from the front part of the washing machine 1, in order to evenly spray washing water to the entire laundry accommodated in the inside of the drum 40.

In the pump room 52, a filter (not shown) for filtering foreign materials included in washing water may be installed. Also, in the pump room 52, a drain pump 54 (see FIG. 3) may be disposed to drain washing water accommodated in the pump room 52 to the outside of the main body 10, and washing water pumped by the drain pump 54 may be guided to the outside of the main body 10 through a drain hose 56.

The circulation apparatus 50 may operate when the washing machine 1 performs washing to wet laundry or to dissolve detergent.

That is, when the washing machine 1 performs washing, the circulation pump 53 may operate to pump washing water stored in the pump room 52, and the pumped washing water may rise along the circulation hose 55 to be sprayed to the inside of the drum 40 through the circulation nozzle 60.

When the washing machine 1 drains washing water, the drain pump 54 may operate to pump washing water stored in the pump room 52, and the pumped washing water may be drained to the outside of the main body 10 along the drain hose 56.

When the washing machine 1 performs spin-drying, both the circulation pump 53 and the drain pump 54 may not operate, and the drum 40 may rotate at high speed to spin-dry laundry.

During spin-drying, a pressure difference may be made between the center area and the outer area of the tub 20 due to the high-speed rotation of the drum 40. Due to the pressure difference, water and bubbles remaining in the tub 20 and the pump room 52 may enter the inside of the drum 40 along the circulation hose 55 although the circulation pump 53 does not operate. In order to prevent the phenomenon, the circulation nozzle 60 may include an air-stream guide 80. The detailed configuration and function of the air-stream guide 80 will be described below.

Figure 3:
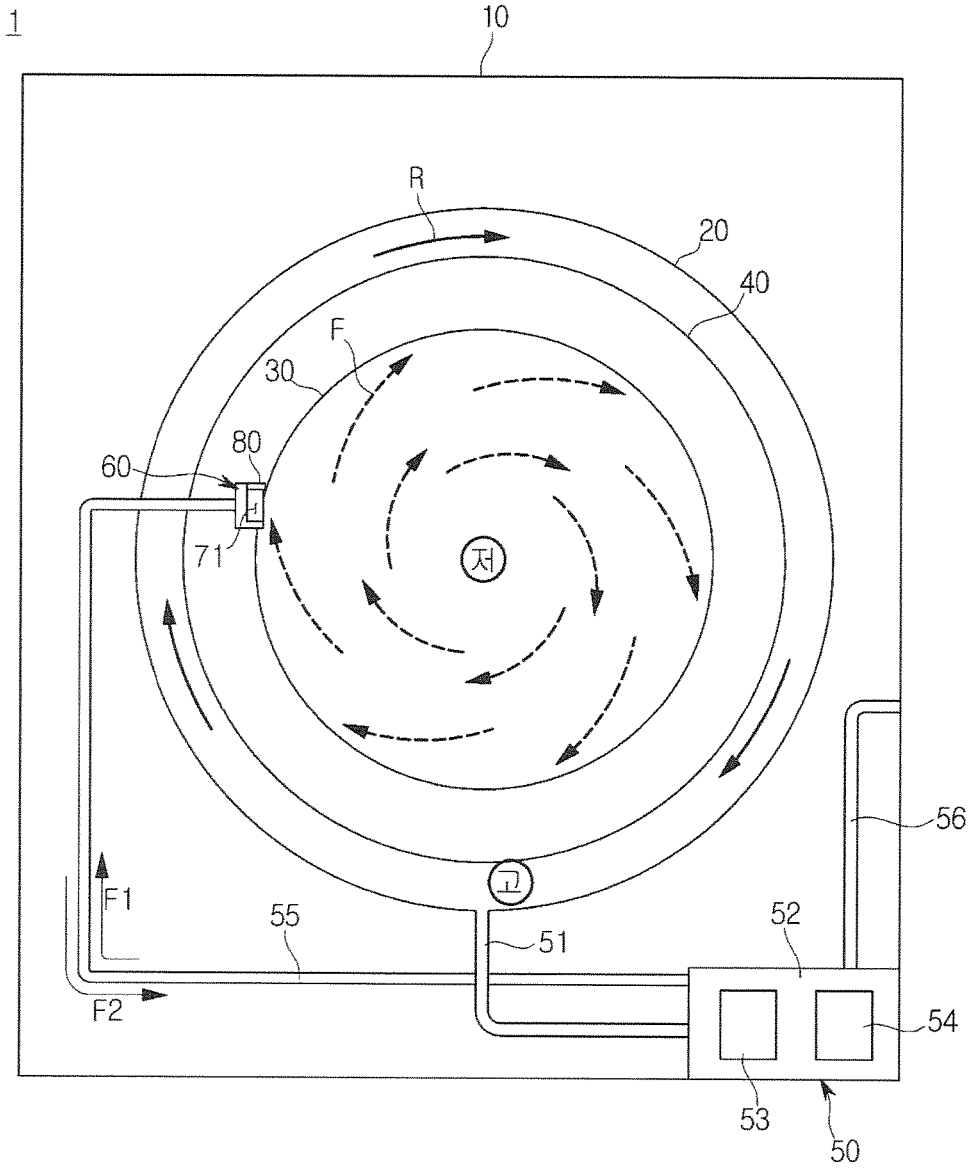
FIG. 3 is a schematic diagram of the washing machine of FIG. 1 seen in a front direction, for describing the function of an air-stream guide to prevent water and bubbles remaining in a tub and a pump room from being supplied to the inside of a drum along a circulation hose due to a pressure difference made between the center area and the outer area of the tub, when the washing machine performs spin-drying in which the drum rotates at high speed.

FIG. 3 is a schematic diagram of the washing machine of FIG. 1 seen in a front direction, for describing the function of an air-stream guide to prevent water and bubbles remaining in a tub and a pump room from being supplied to the inside of a drum along a circulation hose due to a pressure difference made between the center area and the outer area of the tub, when the washing machine performs spin-drying in which the drum rotates at high speed.

Hereinafter, the function of the air-stream guide 80 will be described in detail with reference to FIG. 3. As shown in FIG. 3, when the washing machine 1 is seen in a front direction in the axial direction of the tub 20 and the drum 40, the tub 20 and the drum 40 may have a circle-like shape, and the drum 40 may be located in the inside of the tub 20. Also, since the diaphragm 30 is disposed between the feeding entrance 12 of the main body 10 and the opening 21 of the tub 20 to allow a user to put laundry into the inside of the drum 40, it can be considered that the diaphragm 30 is located in the inside of the drum 40.

In the current embodiment, it is assumed that the drum 40 rotates in a clockwise direction R during spin-drying. The circulation nozzle 60 may be installed at a location between the left portion and the upper portion of the diaphragm 30. If the drum 40 rotates in a counter-clockwise direction during spin-drying, the circulation nozzle 60 may be installed at a location between the right portion and the upper portion of the diaphragm 30.

During spin-drying, the circulation pump 53 may not operate, and the drum 40 may rotate at high speed. The drum 40 may rotate at high speed to generate a centrifugal force, and water included in laundry may be removed from the laundry by the centrifugal force. The water removed from the laundry may enter the tub 20 through the through holes 42 of the drum 40, and flow down due to its own weight to thus be stored in the pump room 52 below the tub 20.

As shown in FIG. 3, if the drum 40 rotates in the clockwise direction R during spin-drying, the inside air of the tub 20 may also rotate in the clockwise direction R to flow from the center area toward the outer area of the tub 20 (F), and accordingly, a low-pressure region may be formed in the center area of the tub 20 and a high-pressure region may be formed in the outer area of the tub 20.

Also, the lower area of the tub 20 corresponding to the entrance of a circulation path for circulating washing water may become a relatively high pressure region, and the area of the tub 20 around the circulation nozzle 60 corresponding to the end of the circulation path may become a relatively low pressure region.

Accordingly, pressure may be applied in a F1 direction to the circulation hose 55, so that water or bubbles remaining in the tub 20 and the pump room 52 may enter the inside of the drum 40 through the circulation hose 55 although the circulation pump 53 does not operate.

In order to prevent the phenomenon, the air-stream guide 80 of the circulation nozzle 50 may guide air-streams of the inside of the drum 40 to a spray opening 71 of the circulation nozzle 60 to generate pressure in a F2 direction capable of cancelling the pressure in the F1 direction.

As shown in FIG. 3, the air-stream guide 80 may be disposed downstream of the spray opening 71 in the movement direction of rotating air-streams in the inside of the drum 40 to guide the rotating air-streams toward the spray opening 71, thereby forming high pressure around the spray opening 71 to generate pressure in the F2 direction capable of cancelling the pressure in the F1 direction.

Figure 4:
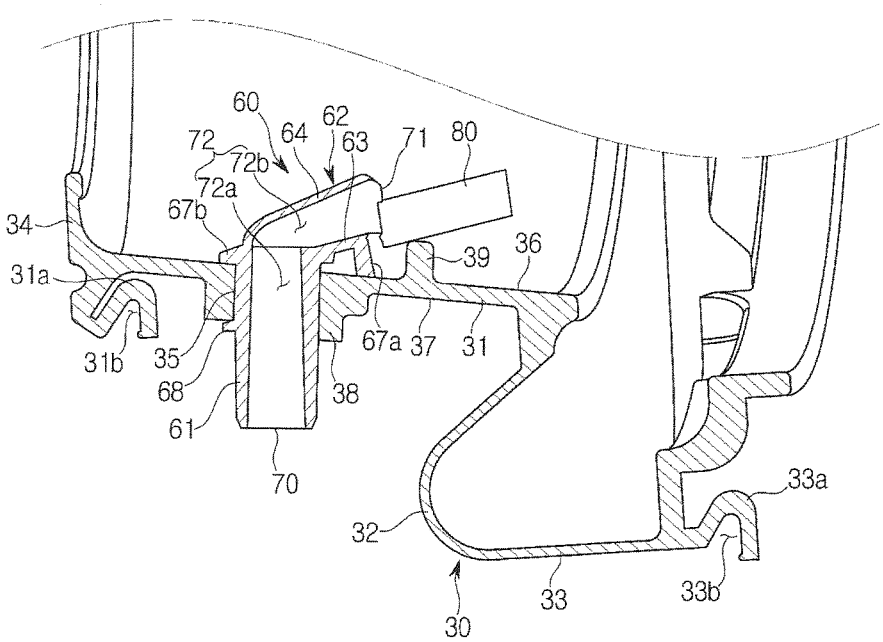
FIG. 4 is a cross-sectional view showing detailed configurations of a diaphragm and a circulation nozzle of the washing machine of FIG. 1.
Figure 5:
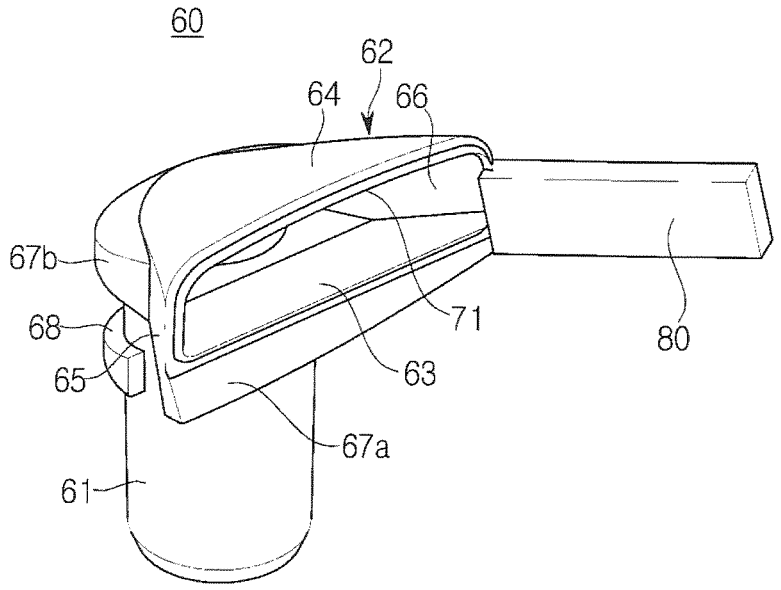
FIG. 5 is a perspective view showing the circulation nozzle of the washing machine of FIG. 1.
Figure 6:
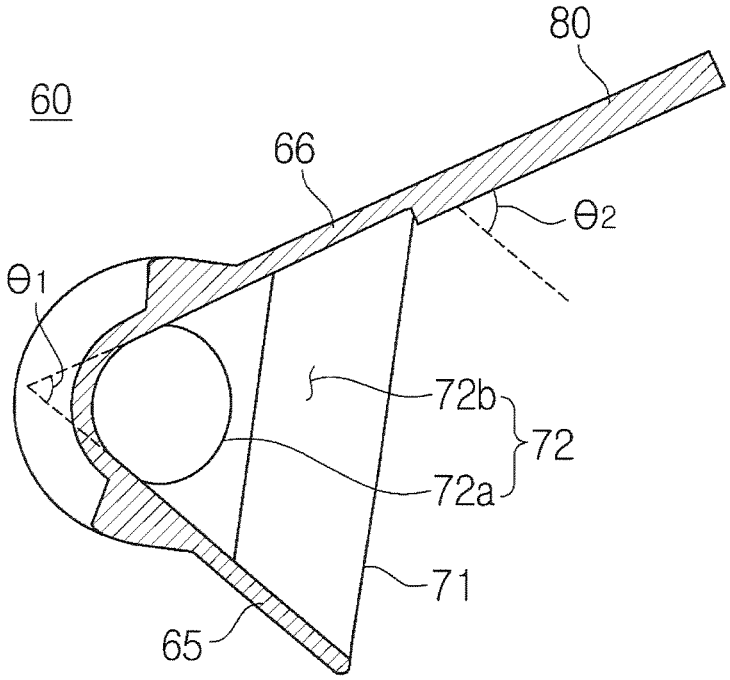
FIG. 6 is a cross-sectional view showing the circulation nozzle of the washing machine of FIG. 1.
Figure 7:
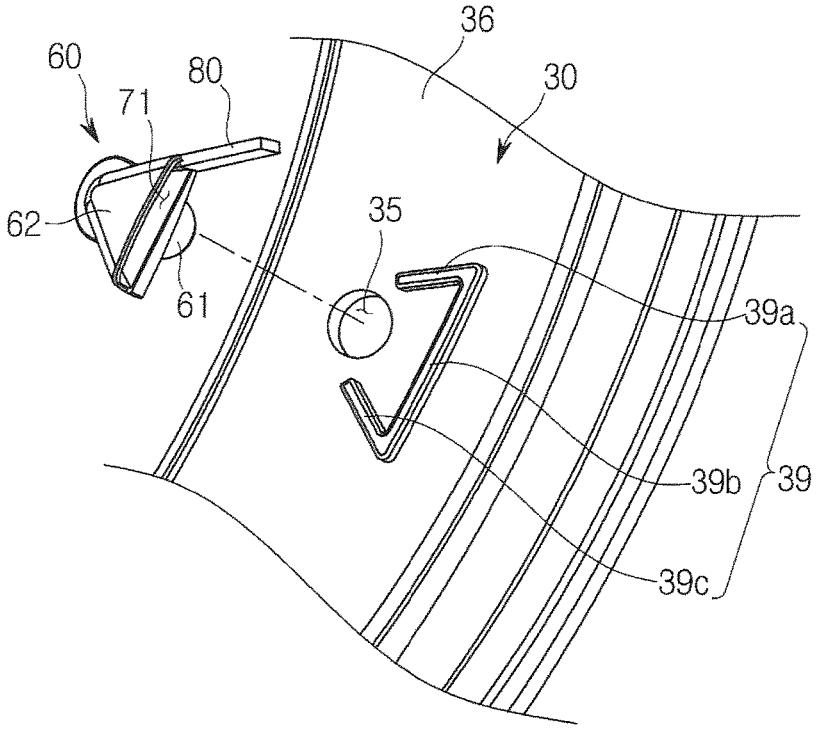
FIG. 7 shows a state in which the circulation nozzle of the washing machine of FIG. 1 is separated from the diaphragm.

FIG. 4 is a cross-sectional view showing detailed configurations of a diaphragm and a circulation nozzle of the washing machine of FIG. 1. FIG. 5 is a perspective view showing the circulation nozzle of the washing machine of FIG. 1. FIG. 6 is a cross-sectional view showing the circulation nozzle of the washing machine of FIG. 1. FIG. 7 shows a state in which the circulation nozzle of the washing machine of FIG. 1 is separated from the diaphragm.

Hereinafter, the detailed configurations of the diaphragm 30 and the circulation nozzle 60 will be described with reference to FIGS. 4 to 7.

The diaphragm 30 may be formed of a rubber material having elasticity, and have a ring-like shape. The diaphragm 30 may include a front portion 31 located in the relatively front area and coupled with the feeding entrance 12 of the main body 10, a rear portion 33 located in the relatively rear area and coupled with the opening 21 of the tub 20, and a buffer portion 32 connecting the front portion 31 to the rear portion 33 and curved at least one time to absorb shock.

In the end of the front portion 31, a front coupling portion 31*a* may be formed in a curved shape to be caught by and coupled with the feeding entrance 12 of the main body 10, and in the outer surface of the front coupling portion 31*a*, a coupling ring installing groove 31*b* may be formed in which a coupling ring (not shown) for surrounding and fixing the main body 10 and the front coupling portion 31*a* is installed.

In the end of the rear portion 33, a rear coupling portion 33*a* may be formed in a curved shape to be caught by and coupled with the opening 21 of the tub 20, and in the outer surface of the rear coupling portion 33*a*, a coupling ring installing groove 33*b* may be formed in which a coupling ring (not shown) for surrounding and fixing the tub 20 and the rear coupling portion 33*a* is installed.

In the front portion 31, a coupling hole 35 may be formed so that the circulation nozzle 60 passes through and is coupled with the coupling hole 35. The circulation nozzle 60 may be pressed in the coupling hole 35 from the inner area toward the outer area of the diaphragm 30 in the radial direction of the diaphragm 30 to thus be coupled with the coupling hole 35. Around the coupling hole 35, a boss portion 38 may be formed to support the circulation nozzle 60 passing through the coupling hole 35. The boss portion 38 may protrude from the outer surface 37 of the diaphragm 30.

In the front portion 31, a door sealing portion 34 may be formed to tightly contact the glass member 92 of the door 90 and seal the door 90.

The circulation nozzle 60 may include a coupling portion 61 disposed to penetrate the diaphragm 30, and a spray portion 62 extending from the coupling portion 61 and configured to change the movement direction of washing water toward the drum 40.

The coupling portion 61 may have a cylinder-like shape, and the circulation hose 55 may be connected to the coupling portion 61. The spray portion 62 may have a fan shape to widely spread sprayed washing water. The spray portion 62 may be located in the inner area in radial direction of the diaphragm 30.

The circulation nozzle 60 may include an inlet 70 to receive washing water from the circulation hose 55, a spray opening 71 to spray the washing water, and flow space 72 connecting the inlet 70 to the spray opening 71.

The inlet 70 may have a circle-like shape, and the spray opening 71 may have a rectangle-like shape to widely spread washing water.

The flow space 72 may include first flow space 72*a* formed in the inside of the coupling portion 61, and second flow space 72*b* formed in the inside of the spray portion 62 and configured to change the movement direction of washing water and to widely spread the washing water.

The circulation nozzle 60 may have inner fixing portions 67*a* and 67*b* that tightly contact the inner area in radial direction of the diaphragm 30 to be supported by the inner area of the diaphragm 30. The inner fixing portions 67*a* and 67*b* may tightly contact the inner surface 36 of the diaphragm 30 to be supported by the inner surface 36 of the diaphragm 30.

The inner fixing portions 67*a* and 67*b* may include a first inner fixing portion 67*a* disposed in a rear direction from the coupling portion 61, and a second inner fixing portion 67*b* disposed in a front direction from the coupling portion 61.

The circulation nozzle 60 may have an outer fixing portion 68 that tightly contacts the outer area in radial direction of the diaphragm 30 to be supported by the outer area of the diaphragm 30. The outer fixing portion 68 may protrude from the outer surface of the coupling portion 61. The outer fixing portion 68 may be formed in at least one area in circumferential direction of the outer surface of the coupling portion 61. The outer fixing portion 68 may tightly contact the boss portion 38 of the diaphragm 30 to be supported by the boss portion 38.

The spray portion 62 of the circulation nozzle 60 may include wall portions 63, 64, 65, and 66 forming the second flow space 72*b* and the spray opening 71.

The wall portions 63, 64, 65, and 66 may include a bottom portion 63 located closer to the diaphragm 30 than the spray opening 71, an upper wall portion 64 facing the bottom portion 63, and a pair of side wall portions 65 and 66 connecting the bottom portion 63 to the upper wall portion 64.

The bottom portion 63 and the upper wall portion 64 may form the longer sides of the spray opening 71, and the pair of side wall portions 65 and 66 may form the shorter sides of the spray opening 71. The pair of side wall portions 65 and 66 may have a wider width toward the outside so as to evenly spread washing water.

The circulation nozzle 60 may include the air-stream guide 80 to guide rotating air-streams generated by rotation of the drum 40 toward the spraying opening 71, and the air-stream guide 80 may protrude toward the drum 40 from one edge of the spray opening 71.

More specifically, the air-stream guide 80 may protrude from the side wall portion 66 located downstream of the spray opening 71 in the rotation direction of the drum 40, among the pair of side wall portions 65 and 66 of the spray portion 62.

By the configuration, rotating air-streams generated by rotation of the drum 40 may be blocked by the air-stream guide 80 to change the movement direction or to form swirling streams, and accordingly, pressure may rise around the spray opening 71 so that a part of the rotating air-streams may flow to the inside of the spray opening 71.

The air-stream guide 80 may have a flat plate-like shape, and the air-stream guide 80 may be configured such that it does not interrupt the flow of washing water sprayed from the spray opening 71 when the circulation pump 53 operates during washing.

That is, as shown in FIG. 6, the pair of side wall portions 65 and 66 may include a first side wall portion 65 and a second side wall portion 66, and if the air-stream guide 80 protrudes from the second side wall portion 66, an angle θ2 formed between the air-stream guide 80 and the first side wall portion 65 may be greater than or equal to an angle θ1 formed between the first side wall portion 65 and the second side wall portion 66. If the angle θ2 is smaller than the angle θ1, washing water sprayed from the spray opening 71 may be interrupted by the air-stream guide 80 to change the movement direction.

Also, for the same reason, the air-stream guide 80 may be positioned at a higher location than the spray opening 71 in the direction of gravity. If the air-stream guide 80 is positioned at the higher location than the spray opening 91 in the direction of gravity, it is possible to prevent falling of washing water sprayed from the spray opening 71 by gravity from being interrupted by the air-stream guide 80 to thus change the movement direction of the washing water.

As shown in FIG. 7, the circulation nozzle 60 may be pressed in the coupling hole 35 of the diaphragm 30 from the inner area toward the outer area of the diaphragm 30 in the radial direction of the diaphragm 30 to thus be coupled with the coupling hole 35.

In the diaphragm 30, a rotation preventing portion 39 may be formed to prevent the circulation nozzle 60 from rotating. The rotation preventing portion 39 may protrude from the inner surface 36 of the diaphragm 30.

The rotation preventing portion 39 may include a first direction rotation preventing portion 39*a* to prevent the circulation nozzle 60 from rotating in a first direction, a second direction rotation preventing portion 39*b* to prevent the circulation nozzle 60 from rotating in a second direction that is opposite to the first direction, and a connection portion 39*b* connecting the first direction rotation preventing portion 39*a* to the second direction rotation preventing portion 39*b* to enhance strength.

After the circulation nozzle 60 is installed in the diaphragm 30, the circulation hose 55 may be coupled with the coupling portion 61 of the circulation nozzle 60.

Figure 8:
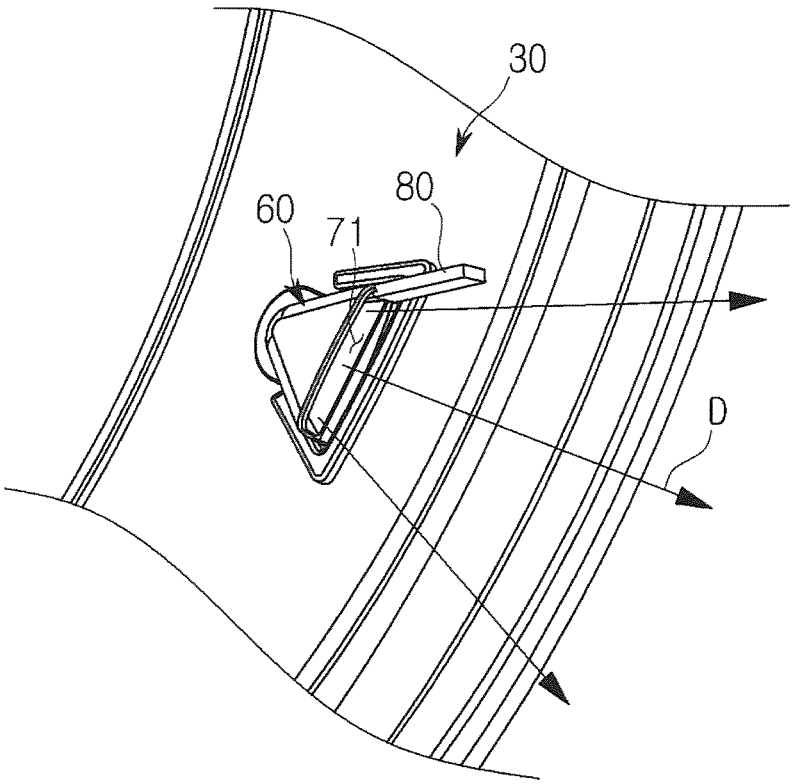
FIG. 8 shows a state in which washing water is sprayed from the circulation nozzle when the washing machine of FIG. 1 performs washing.
Figure 9:
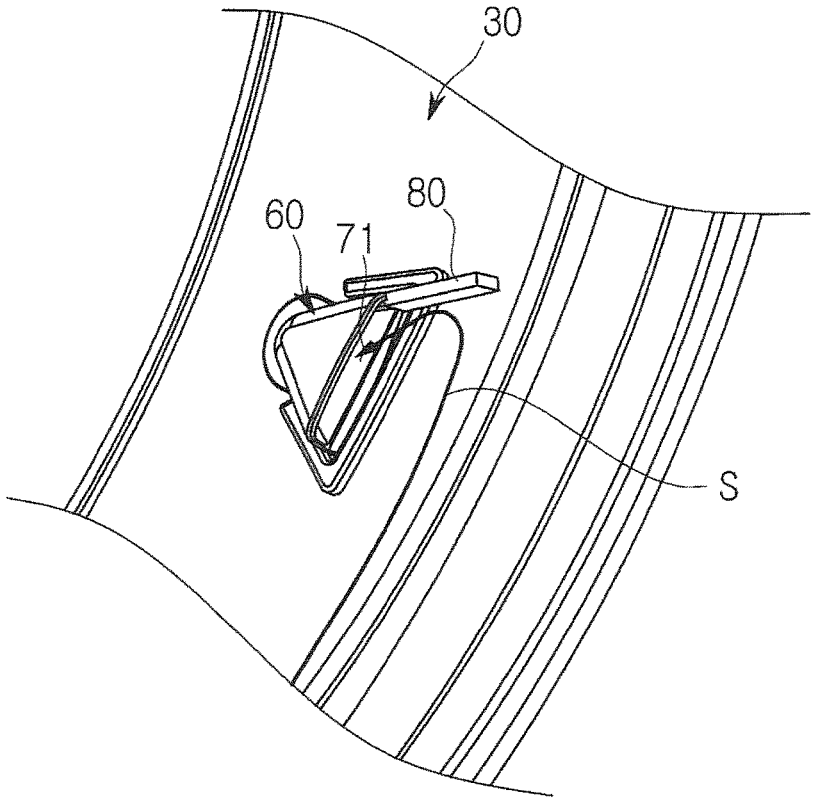
FIG. 9 shows a state in which a rotating air-stream generated by high-speed rotation of the drum is guided toward the spray opening of the circulation nozzle by the air-stream guide of the circulation nozzle when the washing machine of FIG. 1 performs spin-drying.

FIG. 8 shows a state in which washing water is sprayed from the circulation nozzle when the washing machine of FIG. 1 performs washing. FIG. 9 shows a state in which a rotating air-stream generated by high-speed rotation of the drum is guided toward the spray opening of the circulation nozzle by the air-stream guide of the circulation nozzle when the washing machine of FIG. 1 performs spin-drying.

Referring to FIG. 8, if the circulation pump 53 operates when washing is performed, washing water stored in the tub 20 may circulate to be sprayed to the inside of the drum 40 through the spray opening 71 of the circulation nozzle 60.

At this time, the air-stream guide 80 of the circulation nozzle 60 may not interrupt the movement direction D of the washing water sprayed from the spray opening 71.

Referring to FIG. 9, if the drum 40 rotates at high speed while the circulation pump 53 does not operate upon spin-drying, a rotating air-stream S may be generated in the inside of the tub 20, and the air-stream guide 80 of the circulation nozzle 60 may interrupt the flow of the rotating air-stream S to guide the rotating air-stream S toward the spray opening 71.

Figure 10:
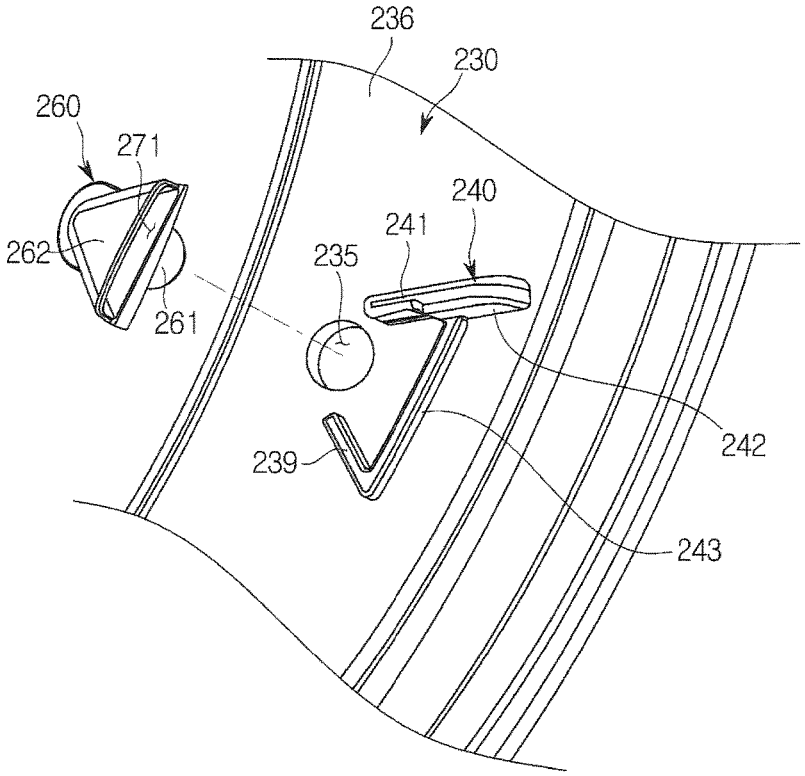
FIG. 10 shows a state in which a circulation nozzle is separated from a diaphragm in a washing machine according to another embodiment of the present disclosure.
Figure 11:
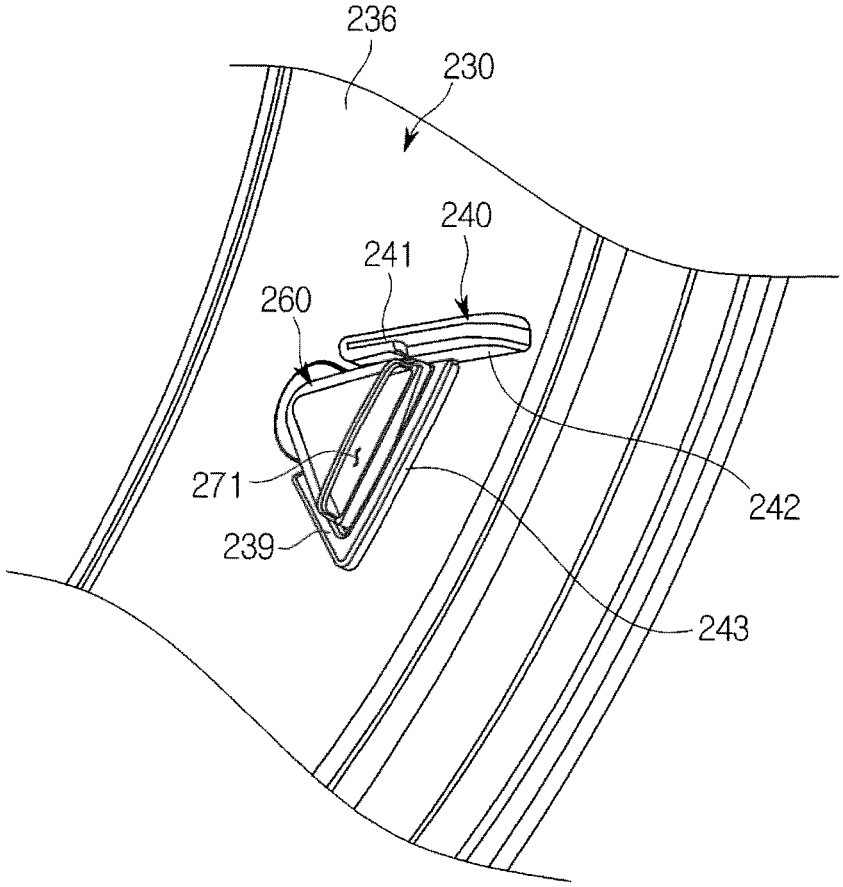
FIG. 11 shows a state in which the circulation nozzle is coupled with the diaphragm in the washing machine of FIG. 10.

FIG. 10 shows a state in which a circulation nozzle is separated from a diaphragm in a washing machine according to another embodiment of the present disclosure. FIG. 11 shows a state in which the circulation nozzle is coupled with the diaphragm in the washing machine of FIG. 10.

Hereinafter, descriptions about the same components as those of the above-described embodiment will be omitted.

According to another embodiment of the present disclosure, an air-stream inducer 240 may be disposed in a diaphragm 230 in order to perform the same function as the air-stream guide 80 disposed in the circulation nozzle 60 of the above-described embodiment.

A circulation nozzle 260 may include a coupling portion 261 disposed to penetrate the diaphragm 30, and a spray portion 262 extending from the coupling portion 261, configured to change the movement direction of washing water toward the drum 240, and having a spray opening 271

In the diaphragm 230, a coupling hole 235 may be formed which the circulation nozzle 260 penetrates to be coupled with. The circulation nozzle 260 may be pressed in the coupling hole 235 of the diaphragm 230 from the inner area toward the outer area of the diaphragm 230 in the radial direction of the diaphragm 230 to thus be coupled with the coupling hole 235.

In the diaphragm 230, a rotation preventing portion 239 may be formed to prevent the circulation nozzle 260 from rotating. The rotation preventing portion 239 may protrude from the inner surface 236 of the diaphragm 230.

The diaphragm 230 may include the air-stream inducer 240 to induce rotating air-streams generated by rotation of the drum 40 to move toward the spray opening 271, and the air-stream inducer 240 may protrude from the inner surface 236 of the diaphragm 230.

The air-stream inducer 240 may include a protrusion 242 protruding toward the drum 40, further than the spray opening 271. The air-stream inducer 240 may be disposed downstream of the spray opening 271 in the rotation direction of the drum 40.

The air-stream inducer 240 may include a rotation limiting portion 241 to prevent the circulation nozzle 260 from rotating. The diaphragm 230 may include a connection portion 243 configured to connect the air-stream inducer 240 to the rotation preventing portion 239 to enhance strength.

According to the technical idea of the present disclosure, the washing machine having the circulation apparatus can prevent water or bubbles remaining in the tub and the pump room from flowing into the inside of the drum along the circulation path of the circulation apparatus, due to a pressure difference made between the center area and the outer area of the tub during spin-drying in which the drum rotates at high speed.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a main body, wherein a feeding entrance is formed in a front portion of the main body;

a tub disposed in the inside of the main body, wherein an opening is formed in the tub in correspondence to the feeding entrance;

a diaphragm configured to connect the feeding entrance to the opening;

a drum disposed in the inside of the tub, and configured to rotate; and a circulation nozzle installed in the diaphragm, and configured to spray washing water drained from the tub to the inside of the drum, wherein the circulation nozzle includes a spray opening configured to spray washing water, an inner wall defining the spraying opening and an air-stream guide configured to guide a rotating air-stream generated by rotation of the drum toward the spray opening, and wherein the air-stream guide protrudes from an end of the circulation nozzle forming an uppermost stream of the spray opening in parallel with the inner wall.

2. The washing machine according to claim 1, wherein the air-stream guide protrudes toward the drum from one edge of the spray opening.

3. The washing machine according to claim 1, wherein the air-stream guide is disposed downstream of the spray opening in a rotation direction of the drum.

4. The washing machine according to claim 1, wherein the circulation nozzle includes a coupling portion disposed to penetrate the diaphragm, and a spray portion extending from the coupling portion and configured to change a movement direction of washing water toward the drum, and wherein the air-stream guide protrudes from the spray portion.

5. The washing machine according to claim 4, wherein the spray portion includes a wall portion forming the spray opening thereinside, and the wall portion includes a bottom portion located closer to the diaphragm than the spray opening, a upper wall portion facing the bottom portion, and a pair of side wall portions connecting the bottom portion to the upper wall portion, and wherein the air-stream guide protrudes from one of the pair of side wall portions.

6. The washing machine according to claim 5, wherein the pair of side wall portions have a wider width toward the outside in order to spread washing water.

7. The washing machine according to claim 5, wherein the pair of side wall portions include a first side wall portion and a second side wall portion, the air-stream guide protrudes from the second side wall portion, and an angle θ1 formed between the air-stream guide and the first side wall portion is greater than or equal to an angle θ2 formed between the first side wall portion and the second side wall portion.

8. The washing machine according to claim 4, wherein the circulation nozzle includes an inlet to receive washing water, and flow space connecting the inlet to the spray opening, and the flow space includes first flow space formed in the inside of the coupling portion, and second flow space formed in the inside of the spray portion and configured to change a movement direction of washing water.

9. The washing machine according to claim 1, wherein the air-stream guide is positioned at a higher location than the spray opening.

10. The washing machine according to claim 1, wherein the circulation nozzle includes an inner fixing portion that tightly contacts an inner area of the diaphragm in radial direction of the diaphragm to be supported by the inner area of the diaphragm in order to fix the circulation nozzle.

11. The washing machine according to claim 1, wherein the circulation nozzle includes an outer fixing portion that tightly contacts an outer area of the diaphragm in radial direction of the diaphragm to be supported by the outer area of the diaphragm in order to fix the circulation nozzle.

12. The washing machine according to claim 1, comprising a circulation apparatus configured to circulate washing water drained from the tub to the inside of the drum, wherein the circulation apparatus includes a pump room disposed below the tub, a circulation pump configured to pump washing water stored in the pump room, and a circulation hose configured to connect the pump room to the circulation nozzle.

13. The washing machine according to claim 1, wherein the diaphragm includes a rotation preventing portion configured to prevent the circulation nozzle from rotating.

14. A washing machine comprising:

a main body, wherein a feeding entrance is formed in a front portion of the main body;

a tub disposed in the inside of the main body, wherein an opening is formed in the tub in correspondence to the feeding entrance;

a diaphragm configured to connect the feeding entrance to the opening;

a drum disposed in the inside of the tub, and configured to rotate; and a circulation nozzle installed in the diaphragm, and including a spray opening configured to spray washing water drained from the tub to the inside of the drum, and inner wall defining the spraying opening, wherein the diaphragm comprises an air-stream inducer configured to induce a rotating air-stream generated by rotation of the drum to move toward the spray opening, and wherein the air-stream inducer protrudes from an end of the circulation nozzle forming an uppermost stream of the spray opening in parallel with the inner wall.

15. The washing machine according to claim 14, wherein the air-stream inducer protrudes toward the drum, further than the spray opening.

16. The washing machine according to claim 14, wherein the air-stream inducer is disposed downstream of the spray opening in a rotation direction of the drum.

17. The washing machine according to claim 14, wherein the air-stream inducer includes a rotation limiting portion configured to prevent the circulation nozzle from rotating.

* * * * *